US010160032B2

(12) United States Patent
Gupta et al.

(10) Patent No.: US 10,160,032 B2
(45) Date of Patent: Dec. 25, 2018

(54) HANDHELD LOOP FORMER FOR BEADING WIRE

(71) Applicant: DPG USA Inc., Schaumburg, IL (US)

(72) Inventors: Nikhil Gupta, Schaumburg, IL (US); John C. Olson, Livingston, TX (US); Ronald C. Farnum, Lombard, IL (US)

(73) Assignee: DPG USA INC., Schaumburg, IL (US)

( * ) Notice: Subject to any disclaimer, the term of this patent is extended or adjusted under 35 U.S.C. 154(b) by 67 days.

(21) Appl. No.: 15/418,806

(22) Filed: Jan. 30, 2017

(65) Prior Publication Data

US 2017/0216904 A1 Aug. 3, 2017

Related U.S. Application Data

(60) Provisional application No. 62/288,228, filed on Jan. 28, 2016.

(51) Int. Cl.

| | |
|---|---|
| ***B21F 1/00*** | (2006.01) |
| ***B21F 1/06*** | (2006.01) |
| *B21F 11/00* | (2006.01) |

(52) U.S. Cl.

CPC ..... *B21F 1/06* (2013.01); *B21F 1/00* (2013.01); *B21F 1/002* (2013.01); *B21F 11/00* (2013.01)

(58) Field of Classification Search

CPC .. B25B 7/22; B21F 45/20; B21F 45/12; B21F 11/00; B21F 1/00; B21F 1/06; B21F 1/002; A44C 27/001; B21D 53/44

See application file for complete search history.

(56) References Cited

U.S. PATENT DOCUMENTS

| | | | | |
|---|---|---|---|---|
| 2,311,695 | A * | 2/1943 | Romanoff | B21F 11/00 30/190 |
| 3,861,430 | A * | 1/1975 | Story | B21F 1/002 140/104 |
| 8,087,138 | B2 * | 1/2012 | Gupta | B25B 7/02 269/278 |
| 9,888,750 | B2 * | 2/2018 | Farnum | B21F 1/002 |
| 2006/0248730 | A1 * | 11/2006 | Miller | B25B 7/22 30/175 |
| 2009/0313835 | A1 * | 12/2009 | Erbrick | B25B 7/12 30/251 |
| 2015/0321243 | A1 * | 11/2015 | Farnum | B21F 1/002 140/102.5 |

* cited by examiner

*Primary Examiner* — Pradeep C Battula
(74) *Attorney, Agent, or Firm* — Robert S. Alexander; Ferrells, PLLC; Anna L. Kinney

(57) ABSTRACT

A handheld loop former for beading wire is provided. The loop former comprises a cutting lever, a slotted forming platform, a forming lever, and two scissors links. The cutting lever has a combination shear blade/forming die at its distal end. The slotted forming platform has a medially located slot, a shearing ledger, and a forming stanchion. The forming lever has a second forming die at its distal end. The cutting lever, forming platform at the medially located slot, and forming lever are journaled together with a pivot pin. Each of the forming lever and the cutting lever is journaled to one of the scissors links. Both scissors links are journaled to the forming platform. The sheer blade/forming die passes closely to the shearing ledger and with the second forming die envelops the forming stanchion when the forming lever and cutting lever are urged together. The forming platform is drawn proximally.

4 Claims, 8 Drawing Sheets

HANDHELD LOOP FORMER FOR BEADING WIRE

CLAIM FOR PRIORITY

This Non-Provisional patent application is based on U.S. Provisional Patent Application Ser. No. 62/288,228, filed on Jan. 28, 2016, the priority of which is claimed, and the disclosure of which is incorporated by reference.

SUMMARY OF THE INVENTION

Beading is a rewarding pastime for many who take considerable pride and pleasure in making attractive items of inexpensive jewelry of their own design for family, friends and for themselves. As in any hobby, certain aspects of the hobby, particularly the creativity, are very pleasurable for participants while other aspects, particularly those that are difficult to carry out with precision even after considerable experience in practice, can be somewhat irksome, becoming part of the pastime that is endured for the sake of the more pleasurable aspects. Forming of a well-shaped loop from beading wire is problematic for many, particularly if they wish for the loop to closely approach being perfectly circular, or for the more technically inclined, annular. It is said that when Leonardo da Vinci left a calling card, he left a hand-drawn perfect circle, this being his sure trademark as few, if any even in his artistic circles, were capable of duplicating this feat. However difficult it is to form a perfect circle, the eye is quite discriminating and easily discerns small variations from the perfect geometric shape. For many beaders, forming a well-formed loop in beading wire is difficult, particularly if their standards are high. In some cases, beaders can form quite presentable loops using so-called chain nose pliers having conical jaws to facilitate forming smooth curves into wire. Even a quick Internet search reveals numerous videos explaining how to use chain nose pliers in forming of wires. However this is not a skill that everyone can master and even more certainly is not a skill that everyone can master easily. Accordingly, this invention relates to a specialized tool for forming loops in beading wire, quickly, reproducibly and with a high degree of precision so that beaders can take considerable pride in the appearance of their work.

The handheld loop former for beading wire of the present invention comprises 3 major parts along with linkages to ensure that the parts move consistently and precisely in relation to each other as the loop forming process is carried out. The loop forming process comprises 3 major steps: (i) sizing the length shear blade wire from which the loop is to be formed; (ii) cutting the wire to the appropriate length; and (iii) forming the loop around a suitable forming member. These operations are carried out by a cutting lever having a combination shear blade/forming die formed thereupon at its distal end, the sheer blade cooperating with a shearing ledger formed on a distal portion of a slotted forming platform having a medially located slot formed therein and a proximally located journal, with the forming platform also carrying an almost distally, penedistally if you will, located forming stanchion proximate to but spaced medially from the shearing ledger, and a forming lever having another forming die formed thereupon at its distal end. The cutting lever and forming lever are journaled together so that by urging together the proximal ends of these levers, the combination shear blade/forming die and the other forming die will approach each other along generally coincident circular paths, while the pin journaling the cutting lever and forming lever rides in the slot of the slotted forming platform such that, as the proximal ends of the handles are pressed together, the shear blade passes inboard of the shearing ledger and in so doing, trims the beading wire to the appropriate length for forming the desired loop with the forming portion of the combination shear blade/forming die urging the trimmed end of the forming wire inwardly around the forming stanchion. Desirably, the forming platform is also joined to the cutting lever and forming lever by a scissors linkage where both links of the scissors are journaled together at the journal of the forming platform with the other ends of each of the scissor links being journaled to penedistal portions of the shear lever and forming lever respectively such that as the proximal portions of the shear lever and forming lever are urged together, the proximal portion of the forming platform is drawn inwardly therebetween such that the forming die portion of the combination shear blade/forming die and the other forming die envelop the forming stanchion so that beading wire in engagement with the forming stanchion is wrapped thereabout forming a nearly circular loop.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE PREFERRED EMBODIMENT

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figure 1:
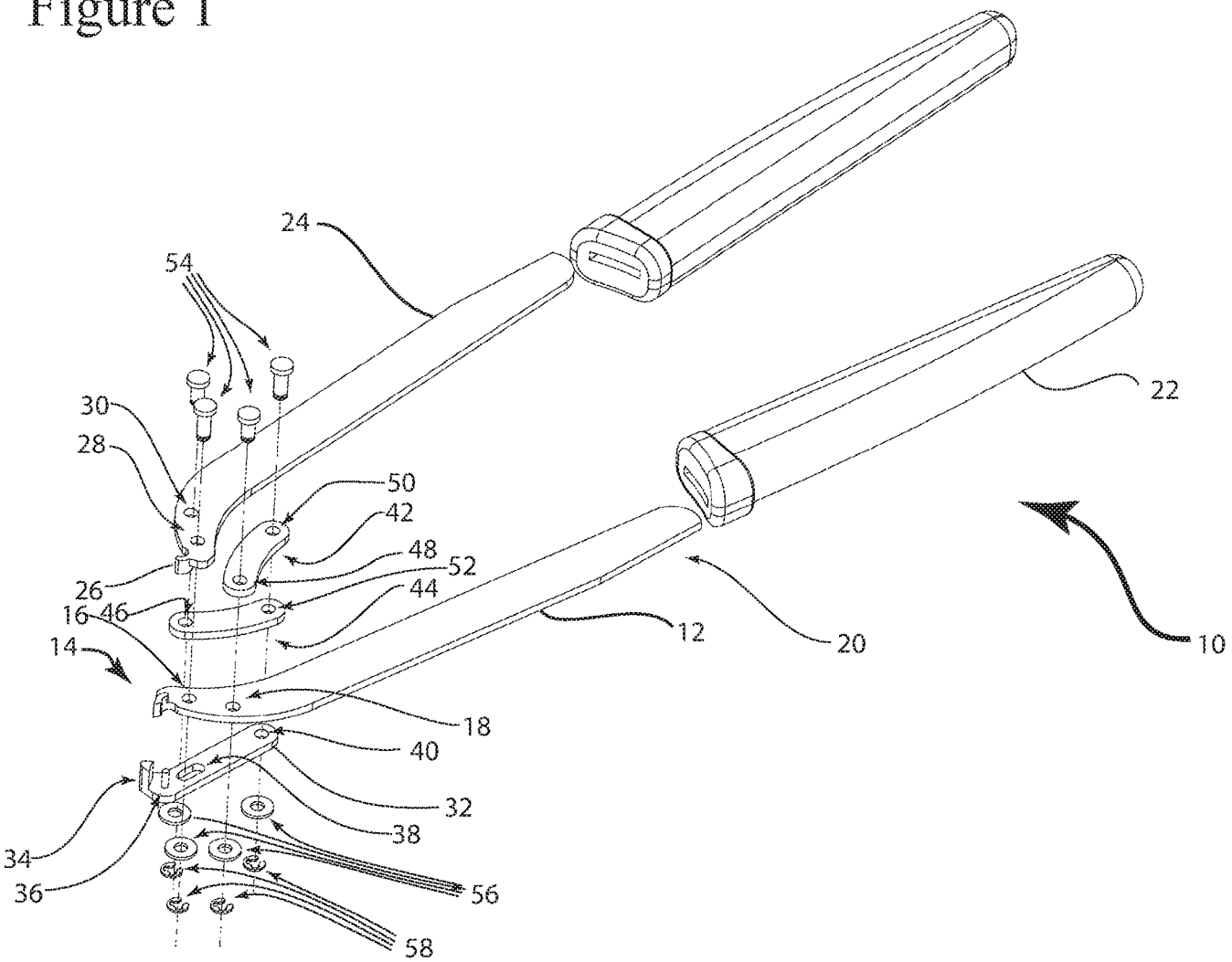
FIG. 1 is an exploded perspective schematically illustrating the components of the handheld loop former beading wire of the present invention.

In FIG. 1, loop former 10 is comprised of cutting lever 12 having combination shear blade/forming die 14 formed at the distal portion thereof having shear pivot journal 16 formed penedistally therein with shear scissors journal 18 formed antepenedistally proximate thereto. Proximal end 20 of cutting lever 12 is provided with cushioned handle pad 22. Forming lever 24 has forming die 26 formed distally thereupon with forming journal 28 being formed penedistally therein and forming scissors journal 30 being formed antepenedistally proximate thereto. Forming platform 32 has shearing ledger 34 formed distally thereupon with forming stanchion 36 being formed proximate thereto penedistally. Translation slot 38 is formed inwardly thereof while forming platform scissors journal 40 is formed in the proximal portion of forming platform 32. Scissors links 42 and 44 are provided with translation journals 46 and 48 as well as pivot journals 50 and 52. When assembled, the constituents of loop former 10 are held together by pins 54 provided with washers 56 and retaining clips 58 to allow smooth motion in cooperation as a portion of wire is cut to length and formed as described hereinafter.

Figure 2:
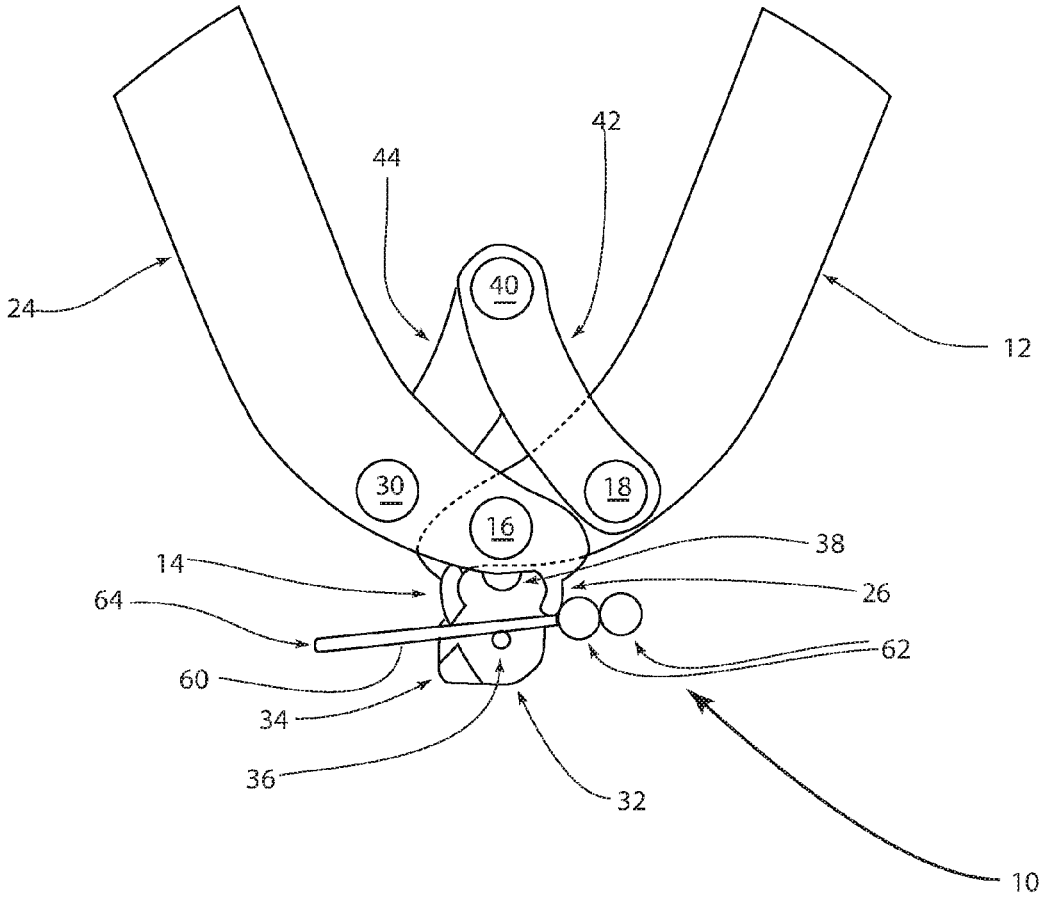
FIGS. 2-8 illustrate the action of the loop forming mechanism as the handles are urged inwardly shearing beading wire therein to length and forming it around the forming stanchion.
Figure 3:
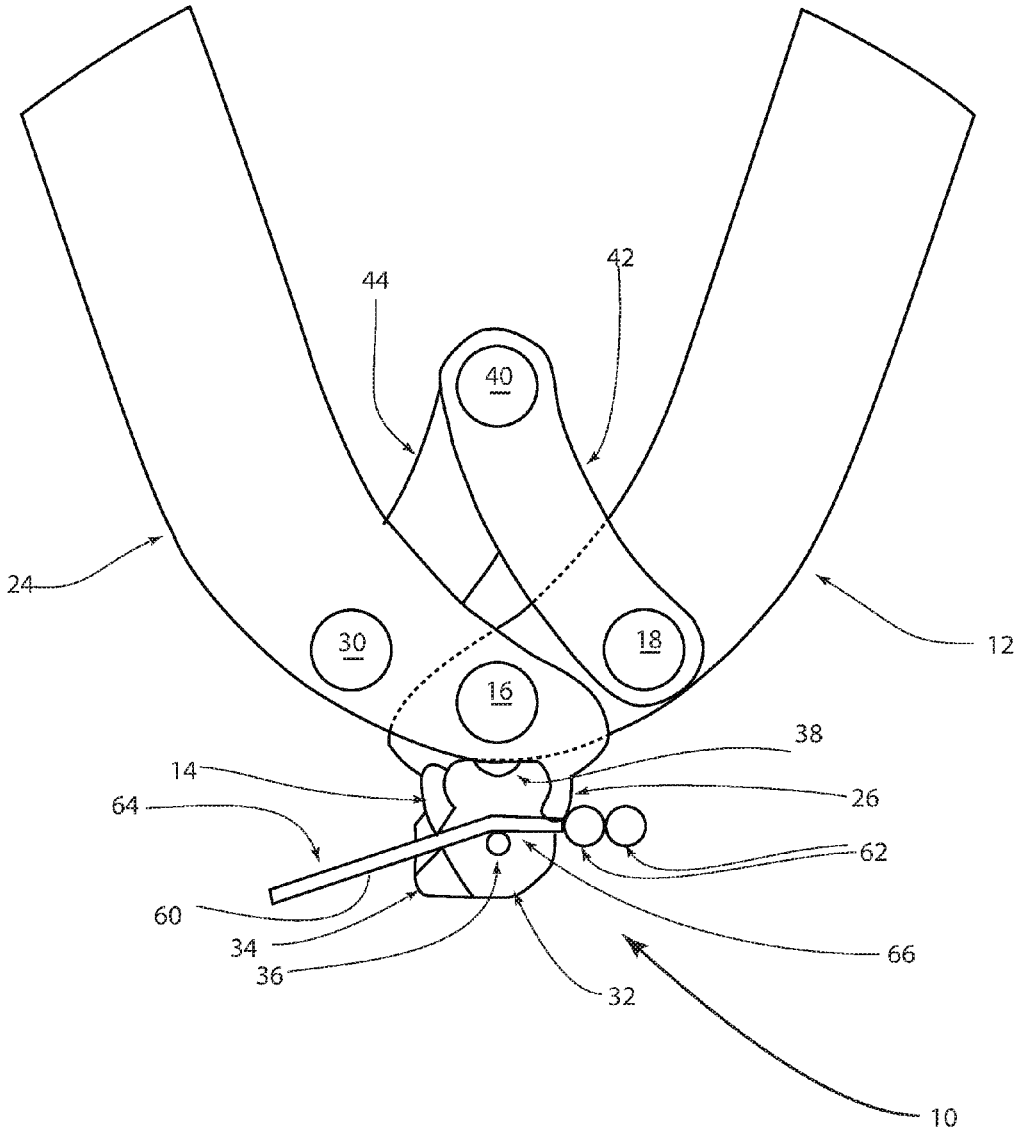
Figure 4:
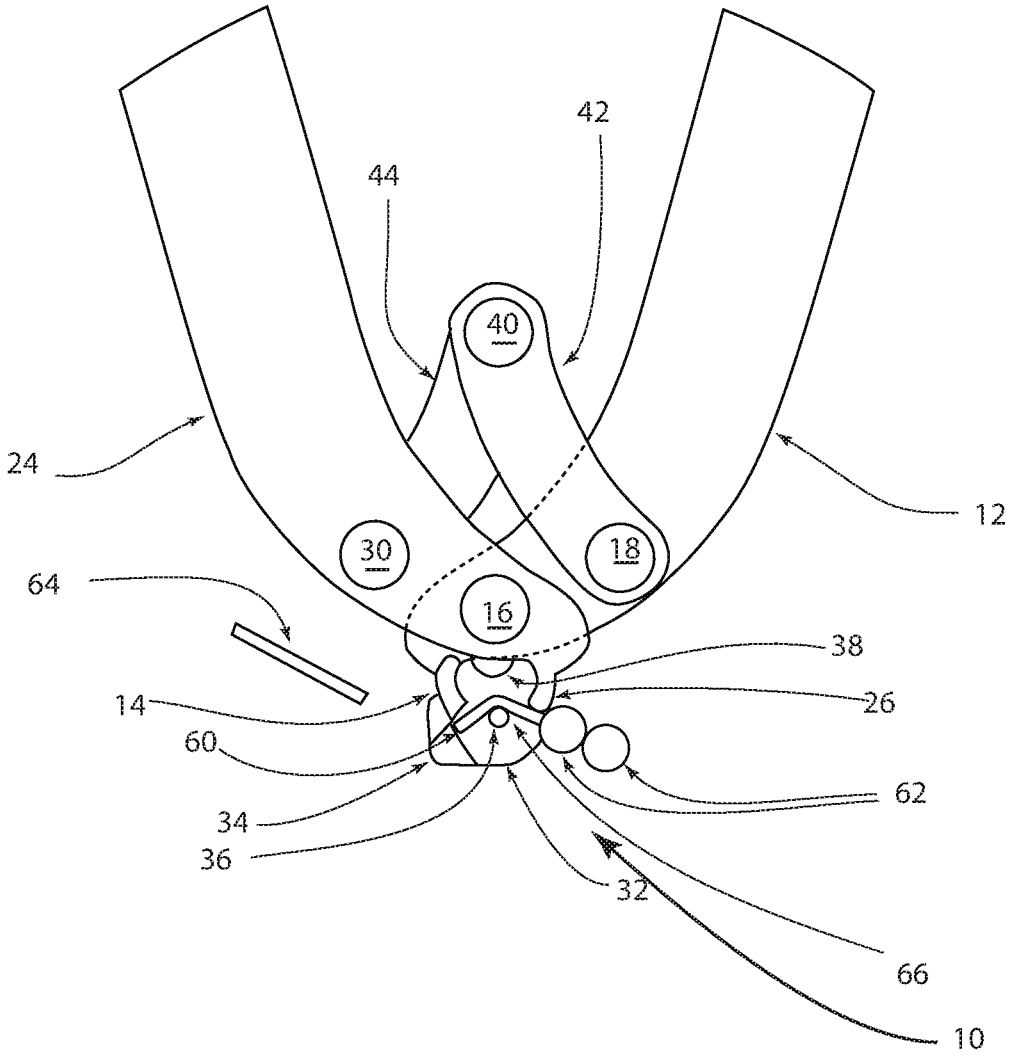
Figure 5:
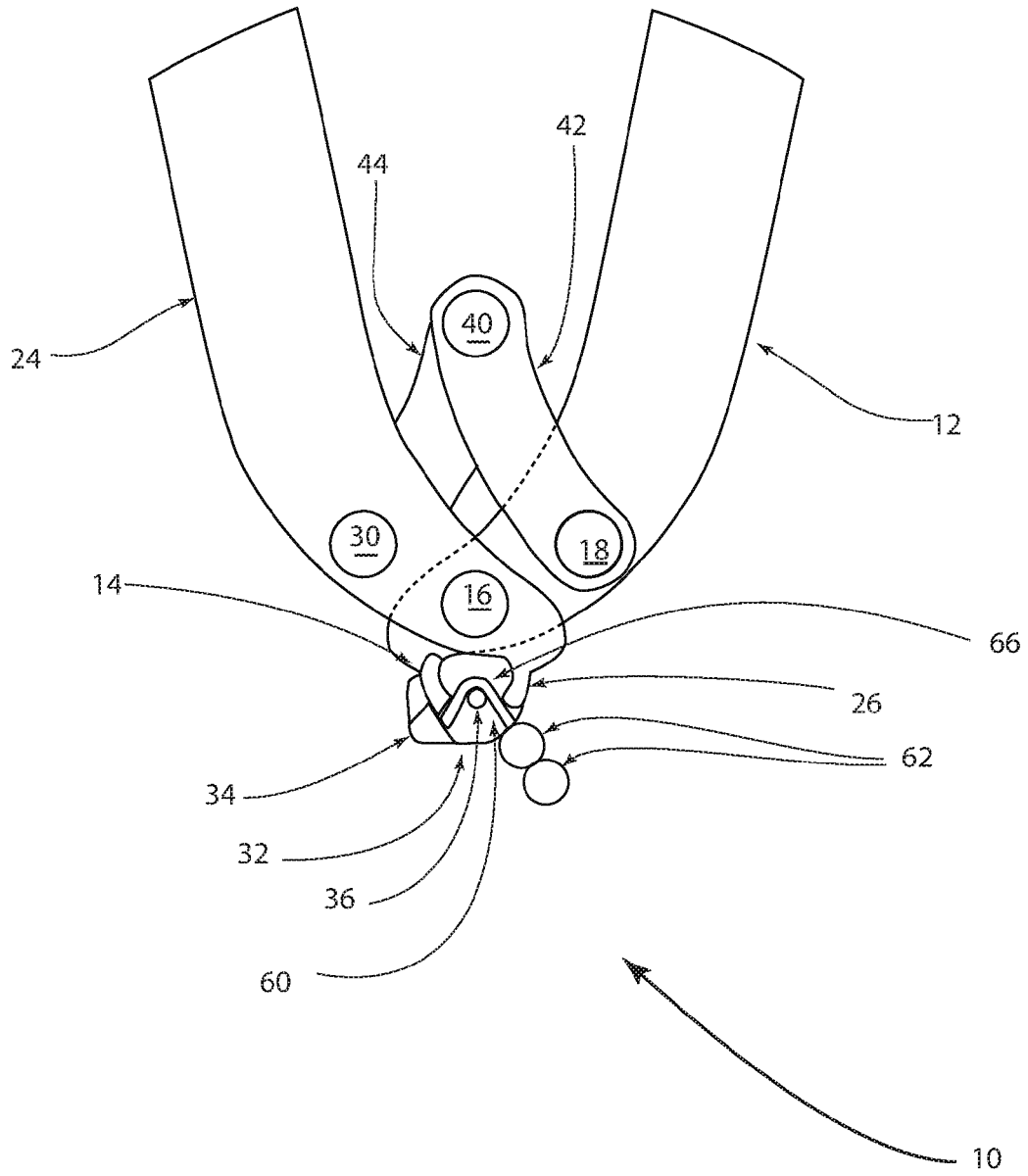
Figure 6:
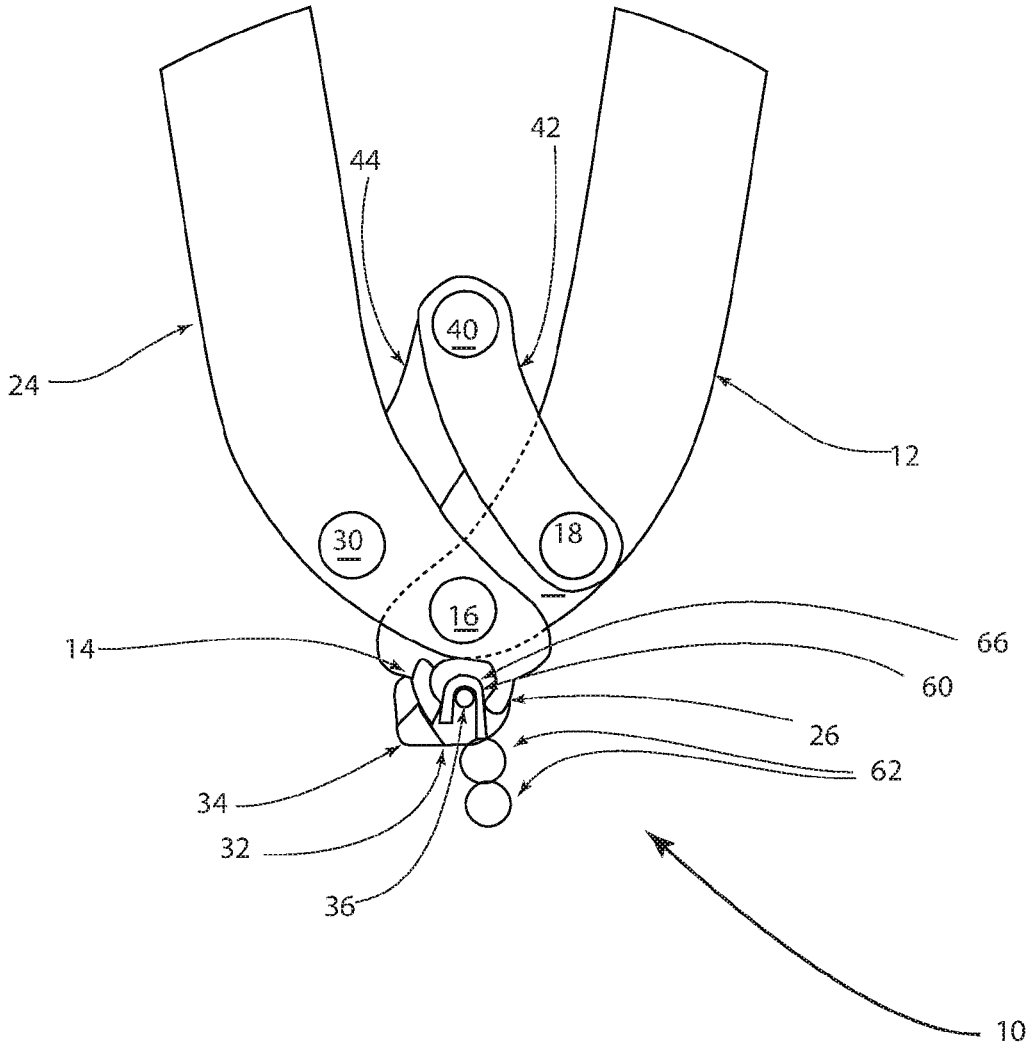
Figure 7:
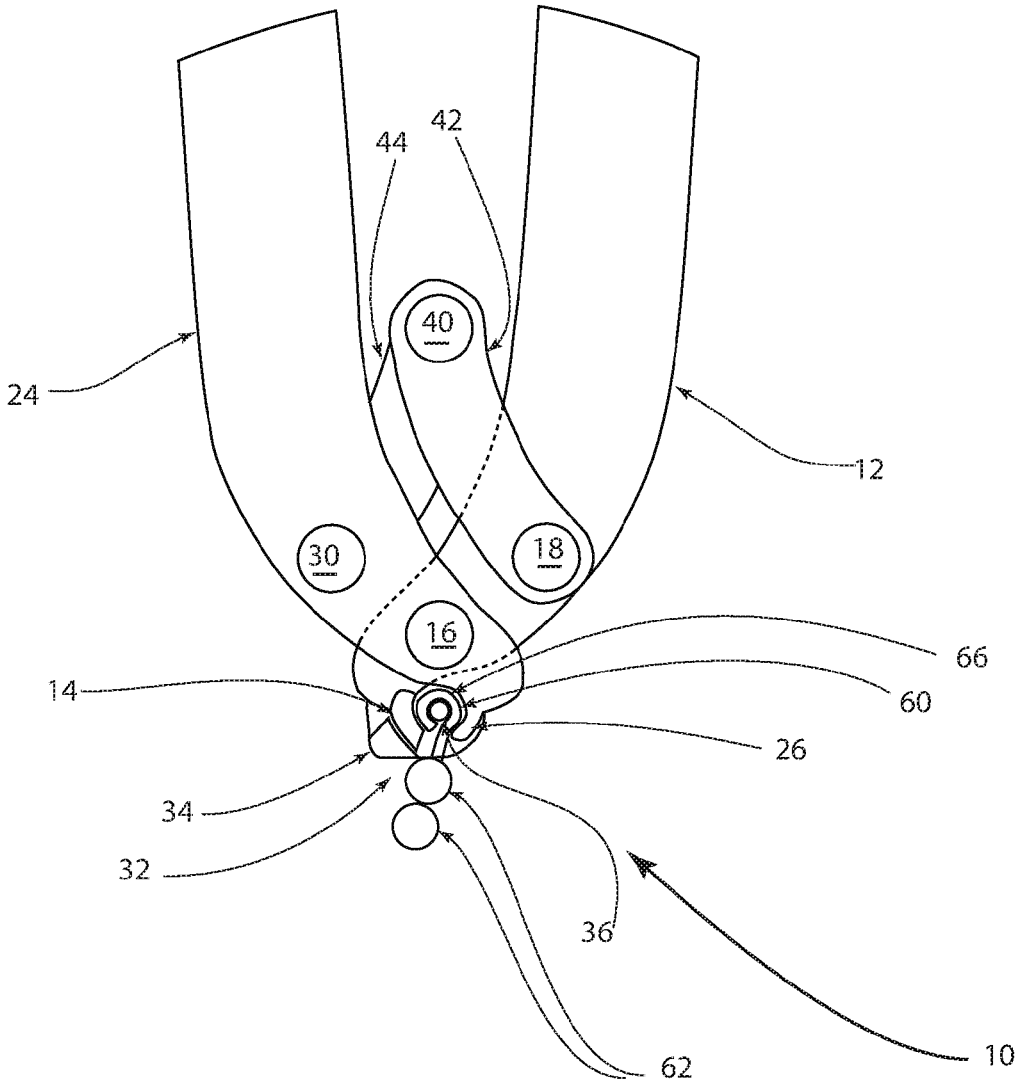
Figure 8:
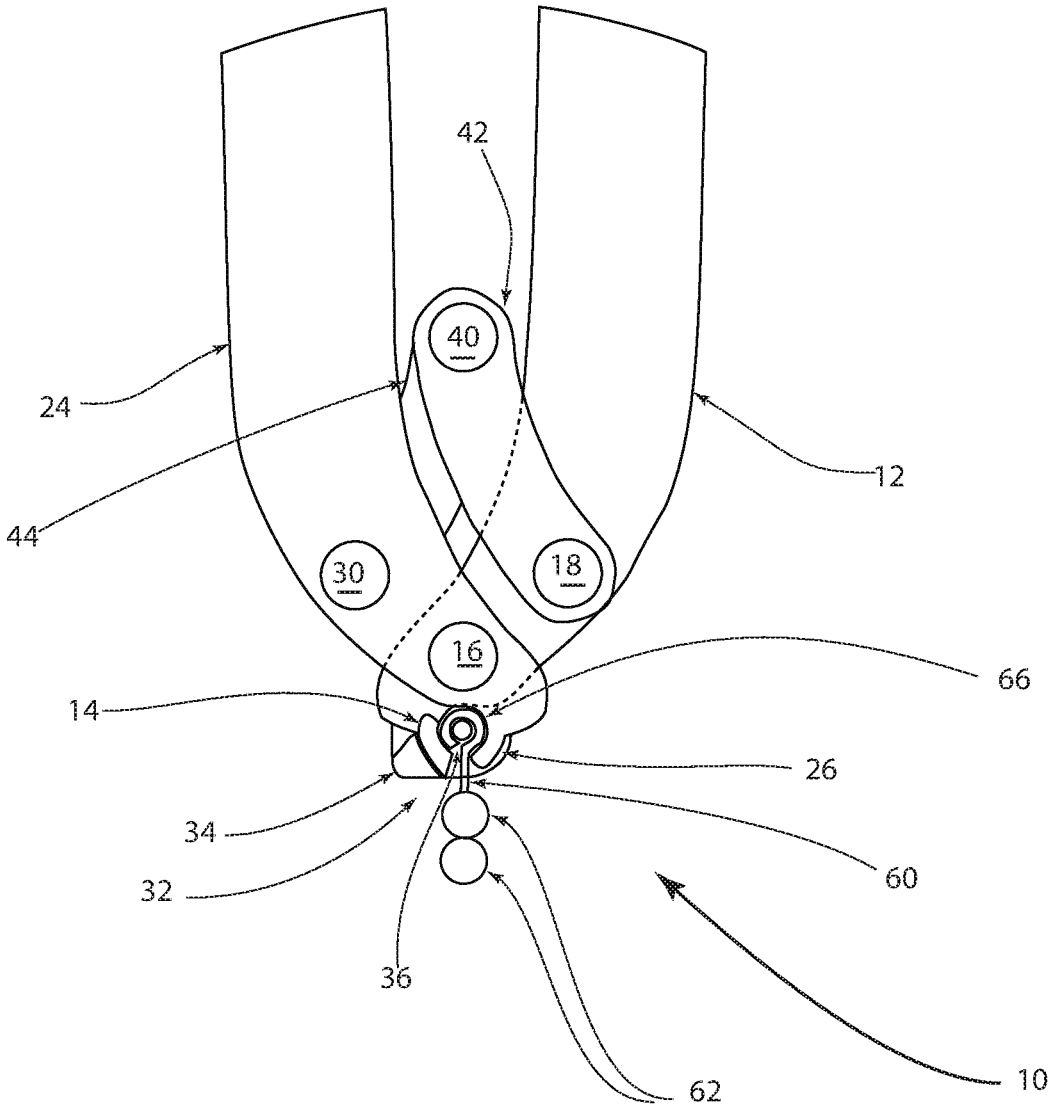

In FIG. 2, wire 60 has beads 62 retained thereupon with projecting end 64 of wire 60 placed in contact with forming die 26, forming stanchion 36 and combination shear blade/forming die 14 with forming stanchion 36 below wire 60 while forming die 26 and combination shear blade/forming die 14 are disposed above it. In FIG. 3, cutting lever 12 and forming lever 24 are beginning to be urged inwardly, drawing forming platform 32 upwardly while forming die 26 and combination shear blade/forming die 14 engage wire 60 while pivoting inwardly and downwardly relative to forming stanchion 36 and shearing ledger 34 on forming platform 32 forming incipient bend 66 in wire 60. In FIG. 4, combination shear blade/forming die 14 has engaged wire 60 and shearing ledger 34 severing projecting end 64 of wire 60 therefrom while forming platform 32 has been drawn further upwardly relative to combination shear blade forming die 14 and forming die 26 amplifying incipient bend 66 in wire 60. In FIG. 5, forming platform 32 bearing shearing ledger 34 has been drawn still further upwardly while combination shear blade/forming die 14 and forming die 26 moving inwardly are beginning to envelop forming stanchion 36 and beginning to wrap wire 60 around forming stanchion 36. In FIG. 6, forming die 26 and combination shear blade/forming die 14 are beginning to envelop forming stanchion 36 forcing wire 60 into a U-shaped bend 66. In FIG. 7, forming platform 32 has been drawn upwardly to such an extent that distal ends of both combination shear blade/forming die 14 and forming die 26 are now below forming stanchion 36 and loop is almost completely formed in wire 60. FIG. 8 illustrates completion of the forming cycle with forming stanchion 36 in its uppermost position with combination shear blade/forming die 14 and forming die 26 enveloping formed loop 66 and forming stanchion 36.

Preferably when loop former 10 is in the conformation illustrated in FIG. 8, the interior surface of combination shear blade/forming die 14 and forming die 26 are separated from forming stanchion 36 by little more than the diameter of forming wire 60 while the lateral separation between combination shear blade/forming die 14 and forming die 26 is similarly only slightly in excess of the diameter of wire 60. Is important to note that the distal extremities of combination shear blade/forming die 14 and forming die 26 are above forming stanchion 36 by a distance roughly equivalent to the diameter of wire 60 at the initiation of the forming process yet both are beneath it by approximately the same distance due to upward translation of forming platform 32 relative to shear pivot journal 16 and forming scissors journal 30 as a consequence of cutting lever 12 and forming lever 24 being urged together.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, we claim:

1. A handheld loop former for beading wire comprising:

a) a cutting lever having a combination shear blade/forming die formed thereupon at its distal end, said cutting lever having a shear pivot journal formed therein proximate said combination shear blade/forming die but displaced medially therefrom and a shear scissors journal formed therein spaced still further medially from said shear pivot journal;

b) a slotted forming platform having a medially located slot formed therein and a proximally located forming platform scissors journal, a shearing ledger formed on a distal portion of said slotted forming platform, and a forming stanchion proximate thereto but displaced medially therefrom;

c) a forming lever having a second forming die formed thereupon at its distal end, a forming journal formed therein proximate said second forming die but displaced medially therefrom, and a forming scissors journal formed therein spaced still further medially from said forming journal;

d) a left scissors link having a proximal journal and a distal journal formed therein;

e) a right scissors link having a proximal journal and a distal journal formed therein;

f) a first pivot pin passing through:

a. said shear pivot journal on said cutting lever;

b. said medially located slot on said slotted forming platform; and c. said forming journal formed in said forming lever;

g) a second pivot pin passing through:

a. the proximally located forming platform scissors journal in said slotted forming platform; and b. said proximal journal of said left scissors link and said proximal journal of said right scissors link;

h) a first scissors pin passing through the distal journal in one of said scissors links and said forming scissors journal in said forming lever; and i) a second scissors pin passing through the distal journal in the other of said scissors links and said shear scissors journal in said cutting lever;

said journals and said medially located slot being disposed such that the combination sheer blade/forming die passes closely proximate to said shearing ledger on said forming platform when the distal ends of said cutting lever and forming lever are urged inwardly, said forming platform translates proximally with said combination shear blade/forming die and said second forming die being spaced proximally above said forming stanchion when said forming lever and cutting lever are widely separated but enveloping said forming stanchion with the distal portions of the combination shear blade/forming die and second forming die being disposed distally beneath said forming stanchion and enveloping said forming stanchion when said forming lever and cutting lever are urged together.

2. The handheld loop former for beading wire of claim 1, wherein said cutting lever and forming lever are journaled together so that by urging together the proximal ends of the forming and cutting levers, the combination shear blade/forming die and the second forming die approach each other along generally coincident circular paths, while the first pivot pin journaling the cutting lever and forming lever rides in the medially located slot of the slotted forming platform such that, as the proximal ends of the forming and cutting levers are pressed together, the combination shear blade/forming die passes inboard of the shearing ledger and in so doing trims beading wire placed medially above said forming stanchion but distally to said combination shear blade/forming die and said second forming die.

3. The handheld loop former for beading wire of claim 2, wherein, by urging together the proximal ends of the forming and cutting levers, the forming die portion of the combination shear blade/forming die urges the trimmed end of the beading wire inwardly around the forming stanchion.

4. The handheld loop former for beading wire of claim 3, wherein by urging together the proximal ends of the forming and cutting levers, a proximal portion of the forming platform having the proximally located forming platform scissors journal is drawn proximally therebetween such that the forming die portion of the combination shear blade/forming die and the second forming die envelop the forming stanchion so that beading wire in engagement with the forming stanchion is wrapped thereabout forming a generally circular loop.

* * * * *